United States Patent [19]

Honda et al.

[11] Patent Number: 4,903,681

[45] Date of Patent: Feb. 27, 1990

[54] METHOD AND APPARATUS FOR CUTTING A CYLINDRICAL MATERIAL

[75] Inventors: Katsuo Honda; Shuichi Tsukada, both of Mitaka, Japan

[73] Assignee: Tokyo Seimitus Co., Ltd., Tokyo, Japan

[21] Appl. No.: 156,748

[22] Filed: Feb. 18, 1988

[30] Foreign Application Priority Data

| | | | |
|---|---|---|---|
| Feb. 24, 1987 | [JP] | Japan | 62-40764 |
| Feb. 24, 1987 | [JP] | Japan | 62-40765 |
| Feb. 24, 1987 | [JP] | Japan | 62-40766 |
| Jan. 6, 1988 | [JP] | Japan | 63-1052 |
| Jan. 6, 1988 | [JP] | Japan | 63-1053 |

[51] Int. Cl.[4] ..... B24B 27/06; B28D 1/04

[52] U.S. Cl. ..... 125/13 R; 125/13 SS; 125/14; 83/22; 83/152; 83/458; 83/460; 83/462; 83/465; 269/21; 269/43; 269/75; 269/269

[58] Field of Search ..... 83/393, 392, 467 A, 83/467, 458, 459, 460, 461–462, 463, 465, 451, 152, 374; 125/13 R, 13 SS, 14; 269/21, 75, 43, 156, 269; 51/283 R

[56] References Cited

U.S. PATENT DOCUMENTS

| | | | |
|---|---|---|---|
| 3,804,397 | 4/1974 | Neumann | 269/21 |
| 3,844,269 | 10/1974 | Rater | 125/13 R |
| 3,855,738 | 12/1974 | Guggenheim, Sr. et al. | 125/13 R X |
| 3,910,620 | 10/1975 | Sperry | 269/21 X |
| 3,941,364 | 3/1976 | Hjelm et al. | 269/296 X |
| 4,110,937 | 9/1978 | Bein | 51/235 X |
| 4,209,005 | 6/1980 | Tremeau | 125/13 R |
| 4,420,909 | 12/1983 | Steere, Jr. | 125/13 R X |
| 4,684,113 | 8/1987 | Douglas et al. | 269/21 |
| 4,771,759 | 9/1988 | Zoebeli | 125/13 R |

*Primary Examiner*—Frank T. Yost
*Assistant Examiner*—Rinaldi Rada
*Attorney, Agent, or Firm*—Oliff & Berridge

[57] ABSTRACT

Method and apparatus for cutting a cylindrical material formed of silicone or the like which is an original material to produce semiconductor devices, using a rotary blade. In the cutting method, the base end side of the cylindrical material is fixed and at the same time, before the cutting of the cylindrical material is started, the cutting side of the cylindrical material is also fixed according to the shape thereof. The cutting is performed while maintaining such fixed conditions until the cutting is completed.

13 Claims, 13 Drawing Sheets

METHOD AND APPARATUS FOR CUTTING A CYLINDRICAL MATERIAL

BACKGROUND OF THE INVENTION

1. Field of the Invention

The present invention relates to a method and an apparatus for cutting a cylindrical material and, in particular, to such method and apparatus in which a rotary blade is used to cut a cylindrical material (which is hereinafter referred to as an ingot) such as silicone or the like to produce semiconductor pieces.

2. Description of the Related Art

An ingot of silicone or the like used as a semiconductor device is fragile and, therefore, when the ingot is sliced into thin pieces with the rotary blade, the thin pieces being sliced may be cracked and thereby separated from the ingot at the cracked portion just before the slicing is completed. In other words, the sliced thin piece, which is generally referred to as a wafer, is chipped in the outer peripheral portion thereof, with the result that the number of semiconductor devices obtainable from a wafer may be greatly decreased.

In order to eliminate the above-mentioned disadvantage, there is employed a slicing method (for example, Japanese Patent Publication (Kokai) No. 61-65749), in which a sacrifice member (which is hereinafter called a slice base) of carbon or the like is attached to a part of the side surface of the ingot longitudinally thereof by means of adhesives or the like, the slicing begins at the side of the ingot opposite to the surface thereof to which the slice base is attached, and the slice base is cut lastly.

According to the above-mentioned slicing method, there can be eliminated the problem that the ingot and the wafer may be broken in part. But, however, the slicing method requires operations to previously prepare and attach the slice base and to remove the slice base from the sliced wafer and, in the slicing method, it is necessary to select a slice base of such a material which does not have ill effects on the cutting edge of the rotary blade.

On the other hand, there is also known another type of slicing method without attaching a slice base to an ingot, in which, while a blade is being rotated, the ingot is also rotated and sliced. (For example, Japanese Patent Publication (Kokai) No. 58-147312). When the ingot is rotated as in the last-mentioned method, since the ingot can be sliced from the periphery thereof toward the central portion thereof, there is eliminated the possibility that the outer periphery of the ingot, which provides a high productivity, may be broken, and the above-mentioned slice base is not necessary, which is advantageous over the formerly-mentioned prior art slicing method. However, from the viewpoint of performance of a slicing apparatus, a further higher accuracy and a further higher function is required.

In other words, when the wafer sliced is collected, according to the above-mentioned slice base attachment method, the wafer may be gripped or may be adsorbed and held by a vacuum chuck when the slice base is cut. On the other hand, according to the ingot rotation method, it is necessary to grip or absorb the wafer at least just before the slicing is completed. However, such absorption or gripping can cause the wafer to be vibrated or twisted, with the result that the wafer may be broken in the central portion thereof. Therefore, in order to solve this problem, it is necessary to rotate a gripping or adsorbing mechanism synchronously and coaxially with the ingot as well as to bring such mechanism into contact with the wafer in a skillful manner. In particular, as in the first slicing of the ingot, when the end face of the ingot is not flat or is not at right angles to the axis of rotation, it is difficult to rotate the ingot coaxially with the vacuum chuck. In this respect as well, it is difficult to realize and maintain the accuracy and function of the whole slicing apparatus. Also, in the ingot rotation method, there can be easily produced a projection as a so called "navel" in the central portion of the wafer when the wafer central portion is not broken. In this case, the projection must be removed and treated, but this after-treatment is very troublesome.

SUMMARY OF THE INVENTION

The present invention aims at eliminating the drawbacks found in the above-mentioned prior art slicing apparatus and methods.

Accordingly, it is an object of the invention to provide a method and apparatus for cutting a cylindrical ingot in which the ingot is not rotated but only a blade is rotated to slice the ingot, avoiding the need for attachment of a slice base to the ingot and also eliminating the possibility that the ingot may be damaged or broken when it is sliced.

In order to accomplish this object, according to one aspect of the invention, there is provided a slicing method in which an ingot is fixed on the base end side thereof and only a blade is rotated to slice the ingot, characterized in that, together with the base end side of the ingot, the slicing side of the ingot is also fixed immovable previously before it is sliced according to the shape thereof and, while such fixed state is being maintained, the slicing by the blade is performed.

According to another aspect of the invention, there are provided a plurality of advanceable and retreatable set pins which can be used to fix the slicing side of the ingot. These set pins are fixed immovable respectively after the set pins are pushed against the ingot slicing side in conformity with the shape thereof, and then the slicing side of the ingot is drawn in toward the set pins so that the slicing side of the ingot can be fixed. Thanks to this, even if the end face of the slicing side of the ingot is not parallel or flat, the set pins can be brought into contact with the end face of the ingot slicing side.

According to a further aspect of the invention, the base end side of the ingot is fixed, there are provided a plurality of cylinders such that they are opposed to the end face of the slicing side of the ingot, and each of pistons respectively provided in the cylinder is equipped with an adsorbing pad which is capable of decompression and suction by means of a spherical bearing, whereby, before starting the slicing of the ingot, the above-mentioned plurality of cylinders are operated to thereby press the respective adsorbing pads against the end face of the ingot and then, after the pressing forces by the cylinders on the adsorbing pads are removed, the pistons in the respective cylinders are respectively fixed immovable (that is, in such a manner that it is prevented from advancing and retreating) while the respective adsorbing pads are being adsorbed against the end face of the ingot, so that the ingot can be sliced by the rotating blade.

In other words, each of the adsorbing pads is journaled by a spherical bearing so that it can be oscillated, the are provided a plurality of adsorbing pads, and the adsorbing pads are arranged such that they can be advanced and retreated by their associated cylinders respectively, that is, the respective adsorbing pads can be brought into contact with the end face of the slicing side of the ingot with no clearance therebetween. Also, although the adsorbing pads are pressed against the end face of the ingot slicing side by the cylinders when the adsorbing pads are brought into contact with the ingot slicing side end face, the pressure by the cylinders are removed after the adsorbing pads are once pushed, in order that no external force from the side of the adsorbing pads can be applied to the ingot end face. Further, with the respective adsorbing pads being in contact with the end face of the ingot slicing side, the pistons of the respective cylinders are fixed such that they cannot be advanced or retreated. Therefore, while the respective adsorbing pads are brought into contact with the end face of the slicing side of the ingot with no clearance therebetween and they adsorb and hold the ingot end face thanks to their adsorbing forces, no forces, such as pushing forces, pulling forces or the like that may change the ingot end face, can be applied to the end face from the side of the adsorbing pads, so that no damage such as breakage or the like can be produced until the slicing is finished.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiments of the method and apparatus for slicing an ingot according to the present invention with reference to the accompanying drawings.

Figure 2:
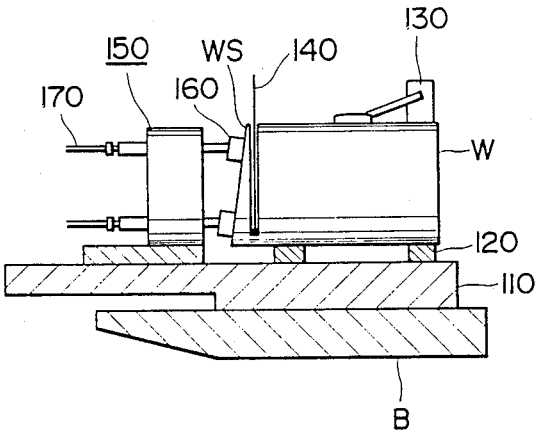
FIG. 2 is a schematic view of the main portions of a first embodiment of an ingot slicing apparatus according to the invention.
Figure 3:
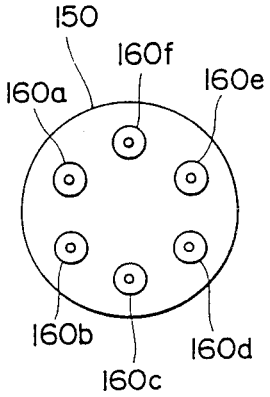
FIG. 3 is a general front view of a vacuum chuck device employed in the first embodiment shown in FIG. 2.
Figure 4:
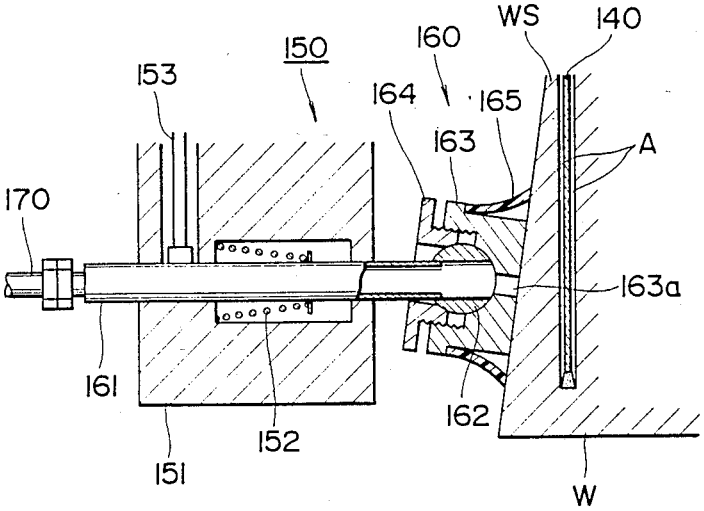
FIG. 4 is an enlarged explanatory view of the vacuum chuck device in FIG. 2, illustrating the structure thereof.

In FIGS. 2 through 4, there is shown a horizontal type of slicing apparatus (namely, slicing machine) in which an ingot W is arranged in a horizontal direction. However, it should be noted that the present invention can be enforced in a similar manner even in a so called vertical type of slicing apparatus. In the drawings, a reference numeral 110 designates a table which is slidably provided on the upper surface of a main body B of the slicing apparatus and the ingot W, which is a material to be sliced, is placed on the table 110 by means of spacers 120. 130 designates a clamper which is used to firmly press (fix) the main body side of the ingot W. In the illustrated embodiment, the clamper 130 is used to firmly press against the ingot W from above, but this is not limitative and other known clamping methods are also available; for example, the end of the ingot can be gripped. 140 designates a blade of an internal peripheral edge type (which is hereinafter referred to as a blade) employing a cutting edge which is formed by attaching diamond particles or the like to the internal peripheral side of a doughnut-shaped thin disc. Reference character WS stands for a wafer which is sliced out sequentially from the ingot W in a required thickness by sliding the table 110 relative to the blade 140. In the illustrated embodiment, there is shown the wafer WS to be first sliced and with an inclined end face. 150 designates a chuck device which is arranged on the table 110 such that it is opposed to the above-mentioned wafer WS and also which is used to adsorb and hold the wafer by means of a vacuum chuck 160 provided in the tip end thereof. The vacuum chuck 160 is connected by means of a vacuum pump (which is not shown) and a vacuum hose. The vacuum chuck 160, as illustrated in FIG. 3 which shows the vacuum chuck 160 from the adsorbing surface side thereof, is composed of a large number of chucks 160*a*, - (in FIG. 3, 6 chucks) each having an adsorbing surface which is a small diameter surface of, for example, 20 mm in diameter. It is preferred that the chucks are coaxially arranged so that they can be dispersed over the whole surface of the wafer to adsorb the wafer whole surface evenly in accordance with the diameters of the ingots (wafers) to be adsorbed and held.

In FIG. 4, there is shown a concrete structure of one of the above-mentioned large number of vacuum chucks.

Referring to FIG. 4, a vacuum rod 161 extending through a chuck device base 151 is arranged such that the rear end thereof is connected to the vacuum hose 170 and there is provided a pad support ball 162 on the front end (tip end) thereof. A vacuum housing 163 is mounted to the support ball 162 by a nut 164 in such a manner that the vacuum housing 163 surrounds the support ball 162. Also, a lip 165 formed of a soft material is mounted to the vacuum housing 163. In the vacuum housing 163 there is formed a ventilating hole 163*a* which, when the wafer is adsorbed, cooperates with the lip 165 to form an adsorbing pad which can adsorb the wafer by bringing the portion enclosed by the lip 165 into a negative pressure state. For this reason, if the vacuum housing has a wafer contact surface which is soft, then such an adsorbing pad can also be employed that eliminates the need for the above-mentioned lip. Also, the adsorbing pad is arranged such that it can be freely inclined, that is, it can be vibrated or oscillated with respect to the pad support ball 162. 152 designates a spring which is located within the above-mentioned chuck device base 151 to always push and advance the vacuum rod 161 toward the ingot (wafer). The spring 152 can be used to dampen the abutting shocks of the chuck 160 when the chuck 160 is slid toward the ingot and positioned in the initial setting thereof. 153 stands for a lock device which is used to fix the vacuum rod at a predetermined position such that it cannot be advanced and retreated. Preferably, the lock device can be operated by an automated mechanism such as a piston rod of an air cylinder.

When the above-mentioned structure is used as a wafer slicing machine as shown in FIG. 2, at first, the ingot W is placed on the table 110 and is then fixed immovable by the clamper 130. In the case of wafer slicing, as the end face of the ingot W is, in general, previously formed flat, after the above-mentioned fixation of the ingot, the chuck device 150 is slided toward the ingot and the vacuum chuck 160 of the chuck device 150 is brought into contact with the end face of the ingot and is fixed at this contact position. After then, the vacuum pump is operated to adsorb the ingot end face by means of the vacuum chuck 160. Here, "to adsorb" means to hold the end face in such a manner that it will never be moved at all any further toward the chuck side or the ingot base side due to the resiliency of the lip 165 or vacuum housing 163 of the vacuum chuck 160 while the wafer WS is being sliced or after it is completely sliced. That is, to adsorb means to balance the adsorbing pressure with the resiliency of the lip and the like. To attain this object, for example, the lip 165 may be formed of a thin rubber material so that it may be very flexible, and the vacuum housing 163 may be formed of resin material or the like which is soft while the contact surface thereof may be formed flat.

After completion of the above-mentioned contact and fixation, the lock device 153 is operated to lock the vacuum rod 161 immovable.

After completion of the locking of the vacuum rod 161, the blade 140 is rotated to slice the ingot W so as to cut out the wafers WS of a required thickness.

In the final region of the ingot slicing (see FIG. 4), since the internal peripheral edge of the blade 140 differs in thickness from the main body of the blade, there is produced a slight clearance A between the main body of the blade and the cut surfaces of the wafer WS and ingot W. Since cutting water and air are present within the clearance A and the blade 140 is being rotated at high speeds, there can be generated surface tension, negative pressure and the like in the clearance A, with the result that there can be generated stress on the wafer WS which is smaller in rigidity.

In the prior art methods, the above-mentioned surface tension or the like causes the wafer WS to move or sway and the concentration of stress occurs in the unsliced portion of the wafer, resulting in the breakage of the wafer. On the contrary, according to the present invention, since from the beginning of the ingot slicing the slicing side (wafer) of the ingot is fixed integrally by the chuck device 150 in accordance with the shape of the ingot, all of the stresses resulting from the negative pressure, surface tension and the like due to the presence of the above-mentioned clearance A are transmitted to the side of the ingot base W and chuck device 150. In other words, the wafer WS, which is fixed and held integrally by the chuck device 150, will never be swayed at any positions where the slicing is carried out and, therefore, there is eliminated the possibility that such stresses as greater than the rigidity of the wafer can be concentrated in the unsliced portion of the wafer, with the result that the slicing of the wafer can be completed without producing any breakage in the wafer. After completion of such slicing, the above-mentioned chuck device is moved to remove the above-mentioned adsorption and locking, and the sliced wafer is collected by use of conventional known means.

In the above-mentioned embodiment of the invention, the adsorbing pad to the wafer is adapted such that it can be oscillated. Thanks to this oscillation, even when the end face of the ingot to be adsorbed is formed inclined as shown in the illustrated embodiment, such inclination can be adsorbed so that the ingot end face can be firmly adsorbed and fixed. On the other hand, there is a fear that the wafer being sliced may be allowed to sway due to this oscillation. However, according to the invention, as discussed before, since a large number of chucks are evenly dispersed on the adsorption end face of the ingot to thereby be able to fix the end face as a whole, there is eliminated the possibility of the wafer being swayed. Also, due to the fact that the above-mentioned adsorption requires only a small area, there are produced no ill effects such as stresses on the adsorption surface or the like.

Figure 5:
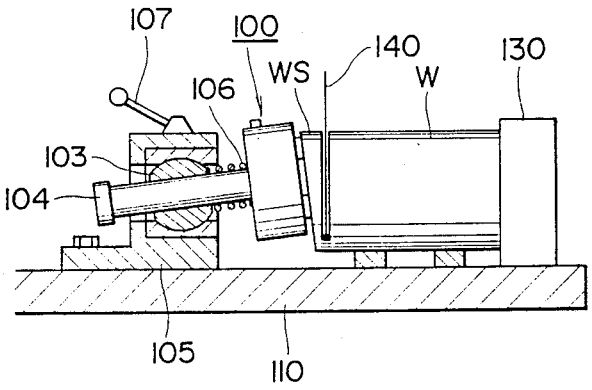
FIG. 5 is a general view of the main portions of a second embodiment of an ingot slicing apparatus according to the invention.
Figure 6:
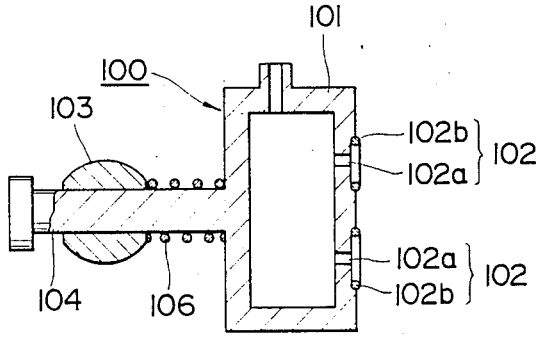
FIG. 6 is an enlarged explanatory view of a vacuum chuck device employed in the second embodiment shown in FIG. 5.

Now, referring to FIGS. 5 and 6, there is shown a second embodiment which is preferred in enforcing the present invention in a slicing machine. As discussed before, in the above-mentioned first embodiment, there are provided a large number of vacuum chucks 160 in the chuck device and the respective vacuum rods 161 of the vacuum chucks are advanced or retreated so that they can be locked individually. On the contrary, in the second embodiment, a chuck device 100 comprises a vacuum housing 101, a large number of chucks 102, which correspond to the vacuum chucks 160 in the first embodiment, are provided on the adsorbing surface of the housing in such a manner that the chucks 102 are dispersed evenly on the adsorbing surface, ventilation holes 102*a* formed in the chucks 102 are adapted to communicate with the interiors of the housing 101, and a vacuum pump (not shown) is connected with the interiors of the housing to be able to obtain a negative pressure condition. Reference character 102*b* designates an O-ring which is provided with an adsorbing pad function. Also, the chuck device 100 is equipped in the rear portion thereof with a support shaft 104 which is inserted through a supporting spherical surface 103, and the supporting spherical surface 103 portion is supported by a support base 105, so that the whole chuck device 100 can be inclined. Numeral 106 designates a spring which is provided with the same function of the spring 52 used in the above-mentioned first embodiment.

The method of utilizing the second embodiment is similar to that of the first embodiment. However, in the second embodiment, a clamper 107 is used to lock the chucks immovable and the chuck device can be locked by tightening the clamper 107. If the respective chucks 102 are formed in the same surface level with accuracy when the chuck device is manufactured, then they are easier to set than those in the above-mentioned first embodiment.

Figure 7:
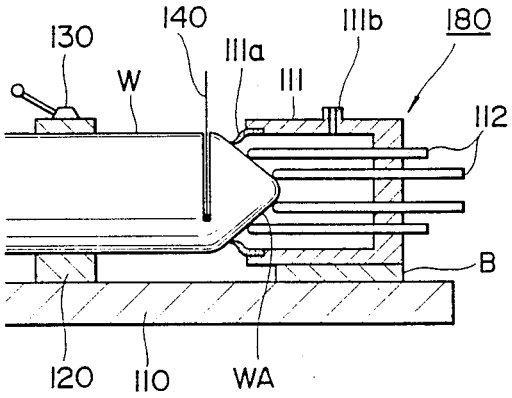
FIG. 7 is a general view of the structure of the main portions of a third embodiment of an ingot slicing apparatus according to the invention.

Referring next to FIG. 7, there is shown a third embodiment preferred in enforcing the present invention in a cutting machine which is used to cut an ingot divisionally, while the above-mentioned first and second embodiments are enforced in the wafer slicing machine.

As mentioned above, the ingot must be sample cut or divisionally cut according to cases before it is sliced to wafers. The ingot, which requires such cutting, has an end which is tapered or substantially conical as shown in the figures. Therefore, the cutting of the ingot having such shape can be carried out simply by use of a vacuum chuck and a large number of support pins.

In particular, numeral 180 designates a vacuum holder device adapted to hold the end of the ingot to be cut which provides the slicing side of the ingot. The vacuum holder 180 includes a main body 111 which is cylindrical in outer shape and the device main body 111 is provided on the opened peripheral edge of the leading end thereof with a relatively flexible lip 111*a* which is formed of rubber or the like. The dimensions of the above-mentioned opening in the main body 111 must correspond to the dimensions of the portion of the ingot W to be adsorbed and held, as will be discussed later. Therefore, when the tapered end portion of the ingot as shown is adsorbed and held, the opening is formed such that it has a diameter which corresponds to the tapered end protion of the ingot. Also, 111*b* designates a ventilation hole to be connected to a vacuum pump (not shown) so as to reduce the pressure of the interior space portion of the holder device main body 111 as required. The vacuum holder device main body 111 is supported by its support base B and can be slid manually or automatically on a table 110. The support base B can be fixed at an arbitrary position by generally known means.

112 designates a plurality of keep pins which are located such that they are surrounded by the holder device main body 111 and the number of the keep pins is determined according to cases. The respective pins 112 are free to advance or retreat axially and are brought into contact with the cutting end portion of the ingot as necessary in such a manner that the respective pins can be advanced or retreated individually in accordance with the shapes of their contact portions. Also, as will be discussed later, the respective pins 112 can be fixed at their advancement or retreat positions.

Figure 8:
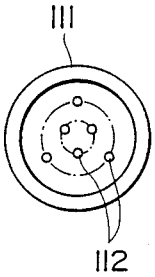
FIG. 8 is a front view of a vacuum holder device, showing how keep pins employed in the third embodiment shown in FIG. 7 are arranged.

In FIG. 8, there is shown a front view of the holder device main body 111, illustrating how the keep pins are arranged. The keep pins are located, for example, coaxially in a concentric circle within the holder device main body, so that they are dispersed evenly with respect to the cutting shape (circular shape) of the cutting end portion WA of the ingot with which the pins are brought into contact. In the illustrated embodiment, three pins are arranged with a phase of 60° on each of inner and outer circles which are virtual dual circles.

Figure 9:
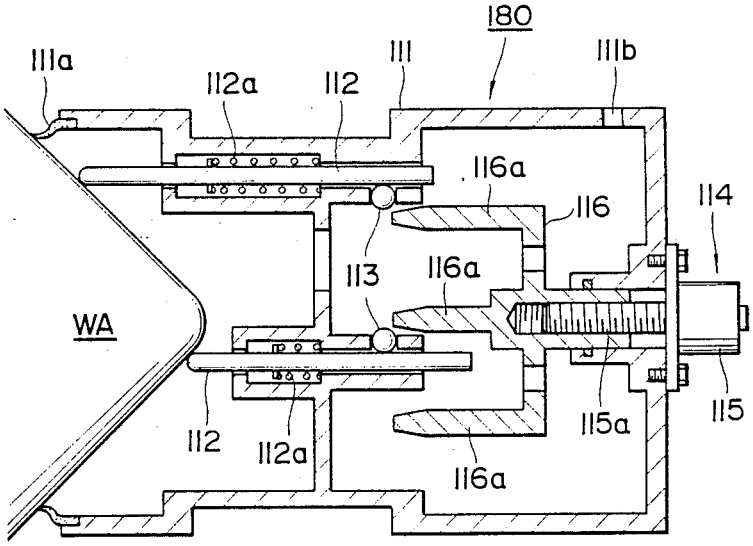
FIG. 9 is a side section view of a concrete structure of the vacuum holder device shown in FIG. 7.

Next, in FIG. 9, there is shown a concrete example of the structure of the vacuum holder device 180. The keep pins 112 shown in FIG. 9 are arranged based on the arrangement in FIG. 8 and one on each of the above-mentioned virtual dual circles is illustrated.

Each of the keep pins 112 is always energized in its advancing direction, that is, in the left direction in FIG. 9 by a spring 112*a* wound round the pin 112, and, when required the pin 112 can be fixed at an arbitrary position by a lock ball 113 which appears or disappears in a direction intersecting perpendicularly with the axial direction of the pin 112. 114 designates a lock mechanism which is used to control the appearance or disappearance of the lock ball 113. The lock mechanism 114 comprises a feed shaft 115*a* (in the illustrated embodiment, a screw shaft for connection with a motor) which is connected with a drive source 115 comprising a motor, a cylinder and the like, and a lock operation body 116 having lock operators 116*a* which are respectively located so as to correspond to the lock balls 113, and which can be feed controlled by the feed shaft 115*a* so as to control the appearance or disappearance of the lock balls 113. Therefore, the lock balls 113 and the lock mechanism 114 cooperate in forming a lock device. As the lock device, there can be employed various kinds of shapes and structures; for example, the lock ball may be in the form of a pin and also the lock operation body 116 may be arranged in a lever structure (for example, a crank shape) which is able to act directly on the keep pins 112.

When the ingot W is cut in the above-mentioned structure, the ingot W is first placed on the table 110 and the base end side of the ingot is fixed immovable by the clamper 130.

Then, the vacuum holder device 180 is slid to thereby bring the lip 111*a* of the holder device main body 111 into contact with the end face (in the illustrated embodiment, it is formed tapered) of the cutting end portion WA of the ingot W which provides the slicing side of the ingot W. Since the lip 111*a* is formed of a flexible material, even when the contact surface of the ingot is slightly undulated, that is, it is not even, the lip 111*a* is capable of closely contacting with the ingot contact surface after such uneven shape.

Accordingly, when the holder device main body 111 is brought into contact with the ingot cutting end portion WA, the keep pins 112 are respectively moved back by their respective amounts of movement from their projected positions along the shape of the cutting end portion WA and are then positioned at their respective positions (see FIGS. 7 and 9).

After the holder device main body 111 is brought into contact with the ingot cutting end portion WA in the above-manner, at first, the support base B for supporting the device main body 111 is fixed immovable on the table 110 by a clamp mechanism (not shown). Next, the lock mechanism 114 is operated so that the keep pins 112 are fixed immovable at the above-mentioned positions by means of the lock balls 113, respectively. After then, a vacuum pump (not shown) is operated to reduce the pressure within holder device main body 111 by means of the ventilation hole 111*b*, so that, with the opening side of the holder device main body 111 being closed by the lip 111*a*, the pressure within the main body 111 is gradually reduced to a predetermined level where the pressure is stabilized.

Although the keep pins 112 are simply in contact with the ingot cutting end portion WA, the holder device main body 111 is adsorbing the ingot cutting end portion WA. In other words, the contact of the keep pins 112 and the adsorption of the holder device main body 111 are combined to have an effect as if they were holding and fixing the ingot cutting end portion WA, so that the ingot cutting end portion can be fixed immovable. Therefore, even if the table is then slid and the cutting of the ingot by an blade 140 is started at a position corresponding to the slide of the table, stress loads generated in such cutting are transmitted and absorbed from the ingot base portion W to the table 110 as well as from the ingot cutting end portion WA through the holder device 180 to the table 110, respectively, so that even in the final cutting region the cutting end portion WA and the like will never be swayed, eliminating the possibility that it may be broken as in the prior art methods and apparatus.

Although in the above-mentioned embodiment description has been given of the ingot cutting end portion which has a tapered shape, as can be understood clearly from the functions and actions of the present invention, the invention is not limited to this. For example, the present invention can also apply to an uneven surface, a flat surface as in a wafer slice, or an inclined surface.

Figure 10:
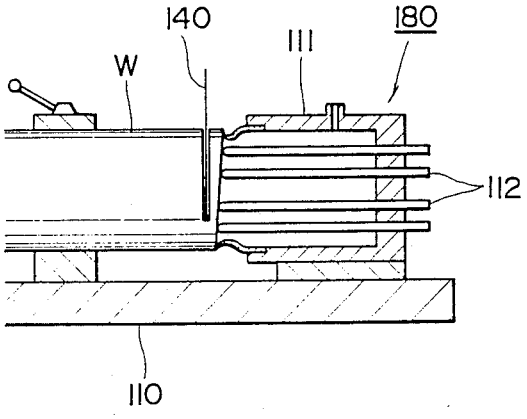
FIG. 10 is an explanatory view of another use of the third embodiment in FIG. 7.

In FIG. 10, there is shown a case in which the invention is applied to the wafer slice.

Specifically, since a plurality of keep pins according to the invention can be advanced and retreated individually and also can be locked at aribitrary positions, respectively, the keep pins can be locked respectively at positions corresponding to the conditions of the respective portions of the ingot end face to be contacted by the keep pins, that is, at positions in accordance with the contact surface, so that the end face can be contacted and fixed evenly.

In this instance, when the slicing thickness is small as in the wafer slice, the vacuum holder main body adsorbs the cutting end face and, when the slicing thickness is great, the vacuum holder device main body adsorbs the outer peripheral portion of the ingot end as in the above-mentioned embodiment.

Figure 11:
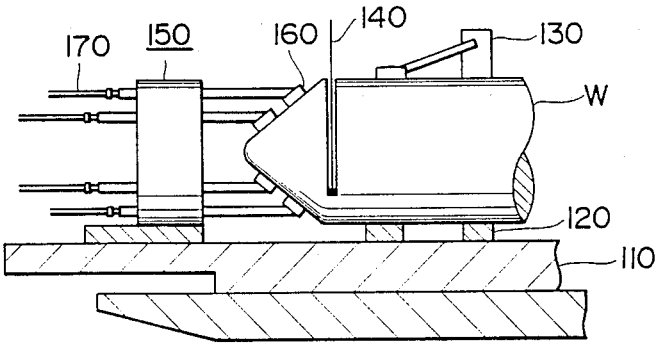
FIG. 11 is an explanatory view of another use of the first embodiment.

By the way, in the above-mentioned ingot cutting, as means for fixing the cutting end portion of the ingot, other means than the above-mentioned means can also be used, that is, the fixing mechanism illustrated in the first embodiment can be used. Specifically, as shown in FIG. 11, the degree of oscillation of the vacuum chuck 160 in the first embodiment is enlarged so that the vacuum chuck 160 is able to adsorb the ingot cutting end portion WA along the inclined surface thereof, thereby attaining the above object.

Figure 12A:
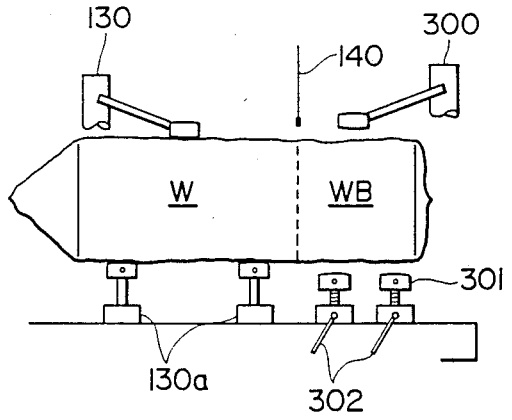
FIGS. 12(*a*)–(*c*) and 13 are respectively general views of the structure of the main portions of a fourth embodiment of an ingot slicing apparatus according to the invention.
Figure 12B:
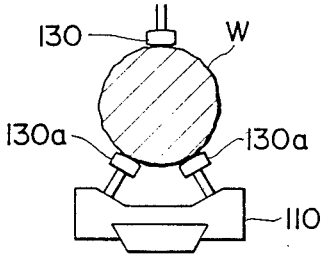
Figure 12C:
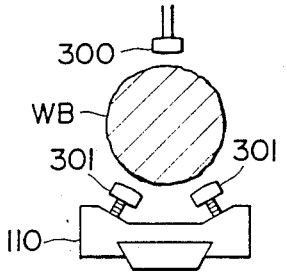
Figure 13:
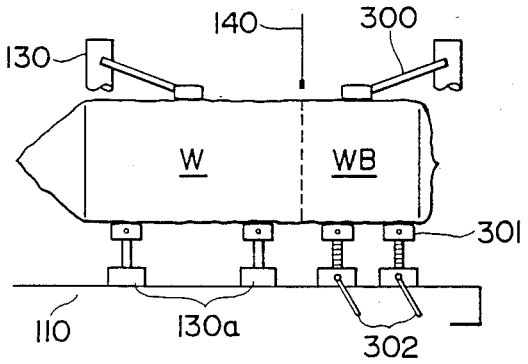

Now, referring to FIGS. 12 and 13, there is shown a fourth embodiment of an ingot cutting apparatus according to the invention.

The third embodiment shown in FIG. 7 is truly ideal in a case when the ingot cutting end portion WA is relatively light in weight. But, especially when a long ingot is divided into several blocks from the intermediate portion thereof, the respective blocks are so great in weight as well as in dimensions that they cannot be fixed by the above-mentioned vacuum chucks.

In such case, as shown in FIGS. 12 and 13, not only the ingot base side is fixed, but also the block side of the ingot to be cut is gripped or pressed such that it is fixed immovable.

In other words, after the base section of the ingot W is gripped or held by use of a clamper 130 and support legs 130*a*, movable support rod seats 301 such as air cylinders or the like which are arranged under the ingot block section WB to be cut are abutted against the ingot block section WB and, with such abutment being maintained, the block section WB is locked by a lever 302 as well as the block section WB is pressed down from above by a clamper 300 for locking. Thus, due to the fact that, after the ingot base section WA is fixed, the ingot block section WB to be cut is fixed immovable by the support rod seats 301 and clamper 300 in accordance with the shape of the block section WB, if the cutting of the ingot by a blade 140 is initiated thereafter, both of the ingot base and block sections will never be swayed to eliminate the possibility that the block may be broken in the final cutting region.

Figure 1:
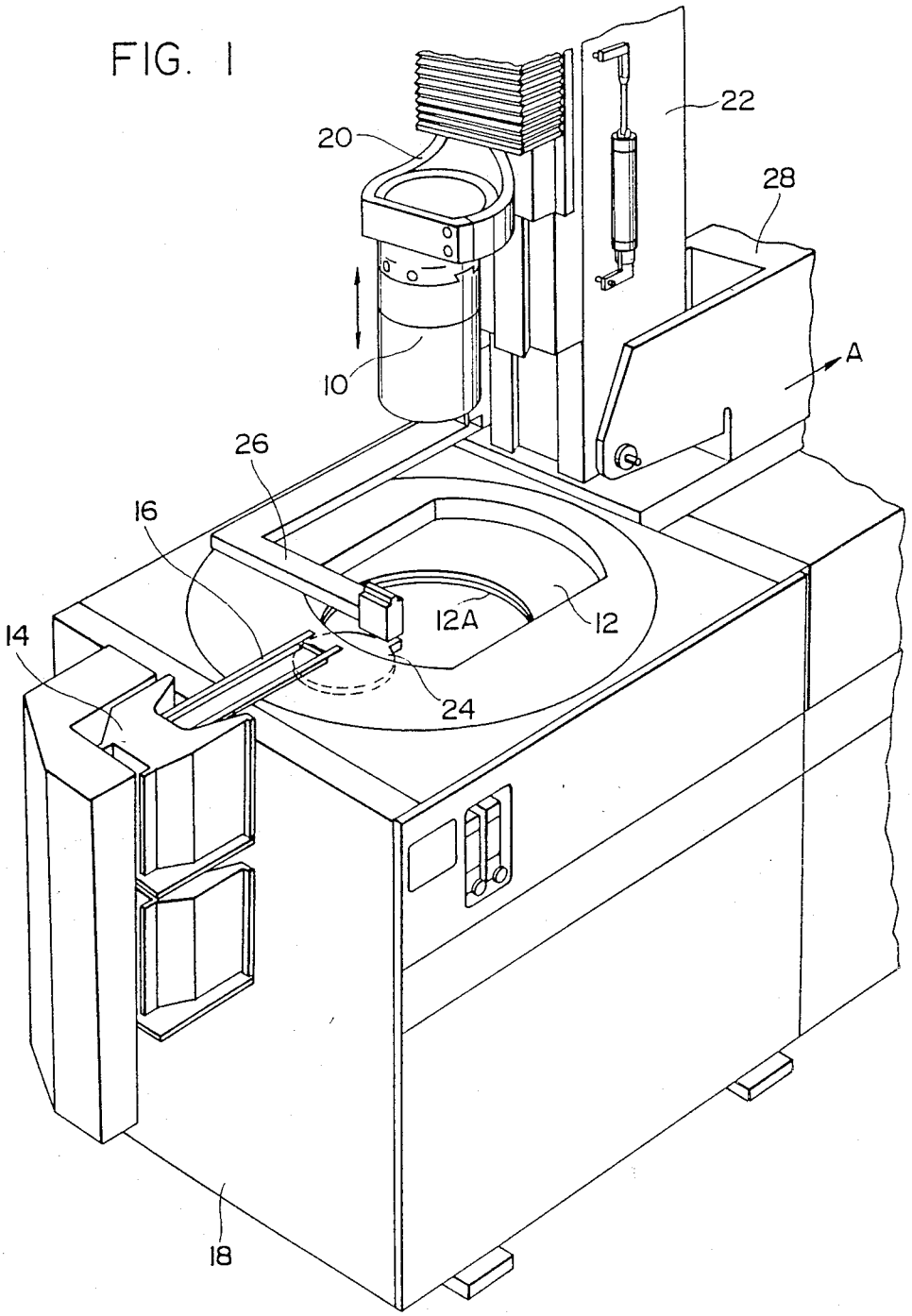
FIG. 1 is a perspective view of the general structure of a fifth embodiment of an ingot slicing apparatus according to the present invention.

Now, in FIG. 1, there is shown a perspective view of a fifth embodiment of an ingot slicing apparatus according to the invention. The present ingot slicing apparatus comprises a main table 18 including an internal peripheral edge type blade 12, a collect conveyor 16 for transporting sliced wafers to a wafer storage cassette 14, and the like; and, a slicing and feeding table 28 including a support prop 22 provided with a feed slider 20 for fixing the base section of an ingot 10 and for moving the ingot 10 in a vertical direction, an arm provided with a collect plate 24 for adsorbing and holding the end face of the cutting side of the ingot 10 during slicing as well as for delivering the wafers to the collect conveyor 16 after slicing, and the like.

Figure 14:
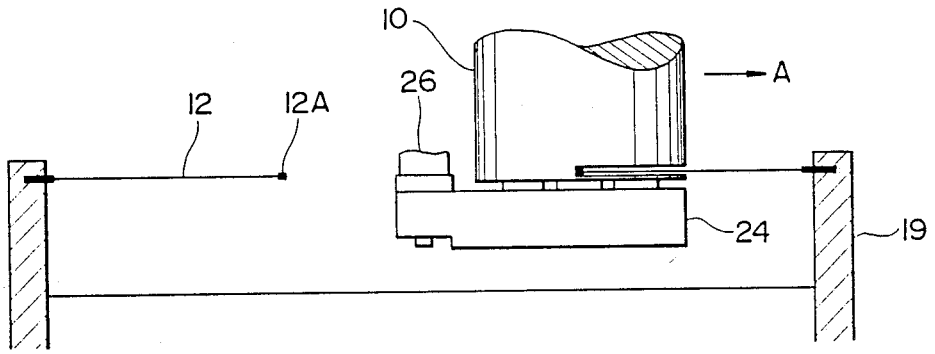
FIG. 14 is a view used to explain the slicing manner by a fifth embodiment of an ingot slicing apparatus according to the invention.

The internal peripheral edge type blade 12, as shown in FIG. 14, is fixed to the upper end of a rotator 19 and can be rotated at high speeds. The blade 12 is adapted to be able to slice the ingot 10 when the slicing and feeding table 28, that is, the ingot 10 is moved in the direction of an arrow A. Also, the thicknesses of the wafers sliced in this manner are determined by the amounts of downward feeding of the ingot 10 by the feed slider 20.

On the other hand, during the above-mentioned slicing, the collect plate 24 adsorbs and holds the end face of the slicing section of the ingot 10 so that breakage or the similar may not be produced in the wafers until completion of the slicing and the collect plate 24 is moved together with the slicing and feeding table 28. The details of the collect plate 24 will be discussed later. Also, after completion of the slicing, the collect plate 24 turns 180° from the position shown in FIG. 14 and subsequently the arm 26 is moved upward and delivers the wafers to the collect conveyor 16 by means of a wafer unloader device (not shown).

Next, description will be given in detail of the above-mentioned collect plate 24 with reference to FIGS. 15, 16 and 17.

Figure 15:
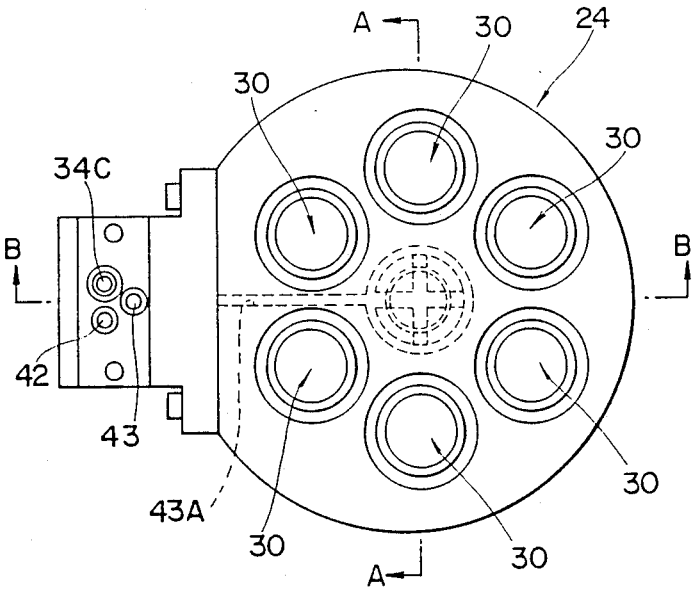
FIG. 15 is a plan view of collect plates used in the fifth embodiment.
Figure 16:
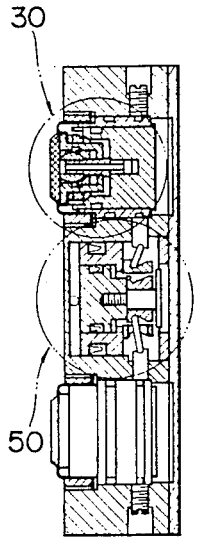
FIGS. 16 and 17 are respectively section views taken along the lines A-A and B-B in FIG. 15 respectively.
Figure 17:
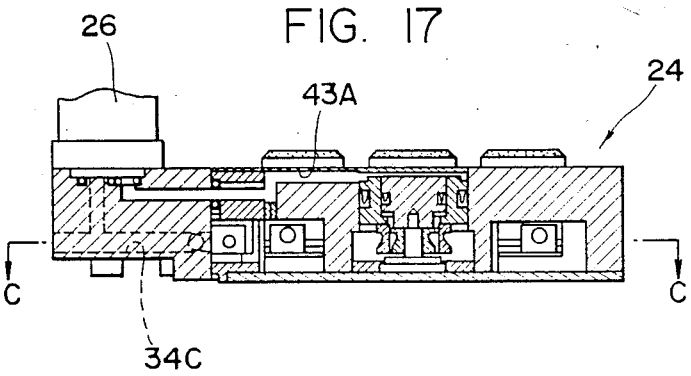

FIG. 15 is a plan view of the collect plate 24, FIG. 16 is a section view taken along the line A-A in FIG. 15, and, FIG. 17 is a section view taken along the line B-B in FIG. 15. As discussed before, the collect plate 24 is provided with the function to adsorb and hold the end face of the cutting side of the ingot 10 while the ingot is being cut. And, in the collect plate 24, as shown in FIG.

15, 6 vacuum chucks 30 are located concentrically at equal intervals so that they can be positioned evenly over the whole surface of the ingot (wafer) correspondingly to the diameter of the wafer.

Figure 20:
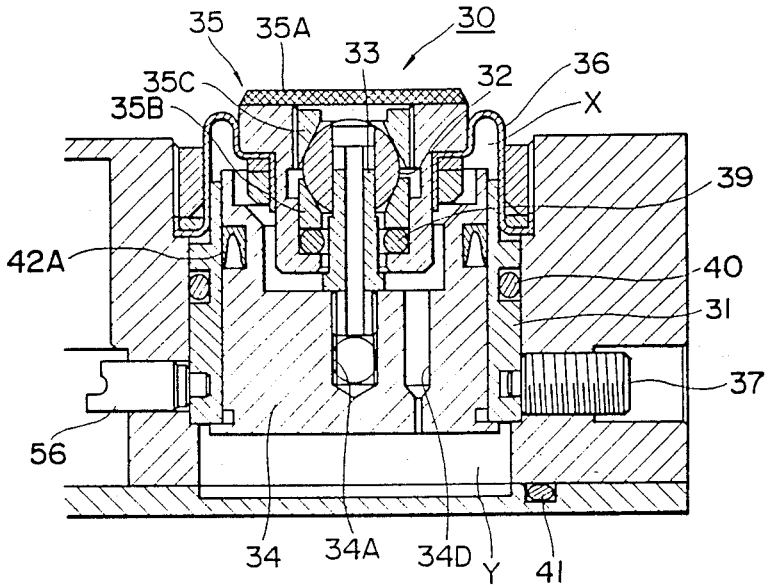
FIGS. 20 and 21 are respectively enlarged views of the vacuum chucks shown in FIG. 16.

Now, referring to FIG. 20, there is shown an enlarged view of the vacuum chuck 30 enclosed by a one-dot chained line in FIG. 16. The vacuum chuck 30 is mainly composed of a cylinder 31 stored and fixed in the collect plate 24, a piston 34 provided with a vacuum rod 33 having a pad support ball 32 in one end thereof, and an adsorbing pad 35 supported by the pad support ball 32.

Figure 21:
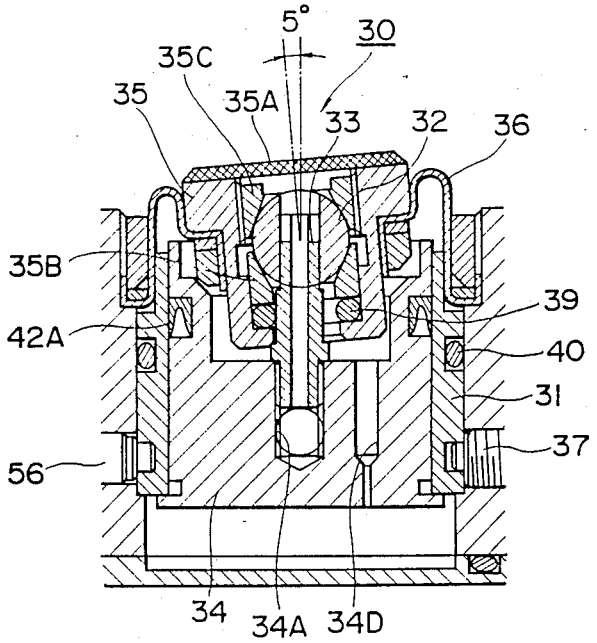

The pad support ball 32 comprises a spherical body which is formed in the central portion thereof with a hole for vacuum. The adsorbing pad 35 is mounted to the pad support ball 32 by holding the pad support ball 32 between the two conical members 35B, 35C of the adsorbing pad 35. That is, there is provided a spherical bearing between the pad support ball 32 and the adsorbing pad 35, so that the adsorbing pad 35 can be inclinable in all directions. Referring to FIG. 21, there is illustrated a state in which the adsorbing pad 35 is inclined 5°.

A setscrew 37 and a clamp pin 56 are fitted into the outer peripheral portion of the cylinder 31, so that the cylinder 31 can be fixed to the collect plate 24 as well as the piston 34 can be clamped by means of the pressure of the clamp pin 56 to be described later.

Figure 18:
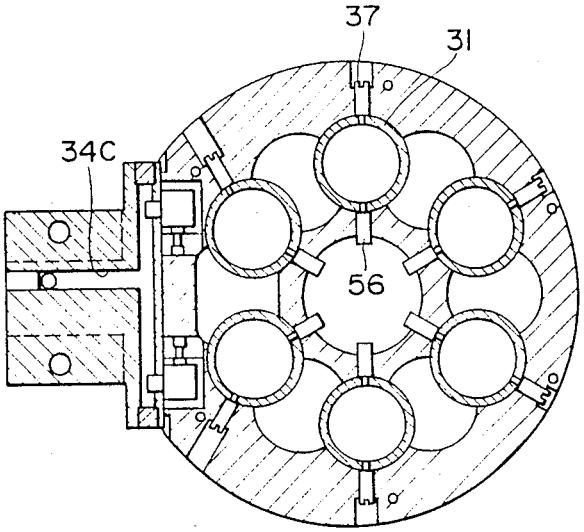
FIG. 18 is a section view taken along the line C-C in FIG. 17.
Figure 19:
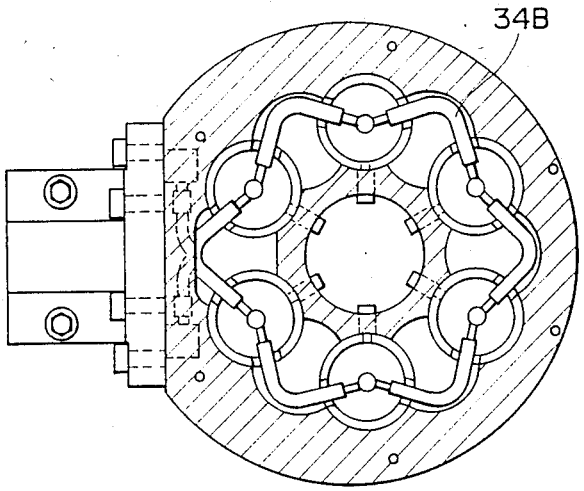
FIG. 19 is a view to show a vacuum tube and the like which can be connected with respective vacuum chucks such that it communicates therewith.

Each piston 34 is formed with a vacuum hole 34A which communicates with the vacuum rod 33, and the vacuum holes 34A of the respective pistons 34, as shown in FIG. 19, are allowed to communicate by means of a vacuum tube 34B. Also, the leading and following ends portion of the vacuum tube 34B communicates with a vacuum hole 34C formed on the side of the collect plate (see FIG. 17 and FIG. 18 which is a section view taken along the line C-C in FIG. 17) and then communicates with a vacuum hole (not shown) formed in the arm 26. Further, in the piston 34, there is formed a ventilation hole 34D which is used to maintain the pressures of the piston upper and lower portions in the same level to thereby prevent the generation of hysteresis of the adsorbing pad 35 due to the slight air leakage in the spherical bearing. In other words, in FIG. 20, if a slight air leakage occurs in the spherical bearing, then there is produced a negative pressure in an X section, resulting in X Y(atmospheric pressure). That is, the resultant pressure difference between the X and Y sections produces an upward force F which acts on the piston 34. However, the above-mentioned ventilation hole 34D can be used to prevent any pressure difference from being produced between the X and Y sections.

Also, in the leading end of the adsorbing pad 35, there is arranged a porous pad 35A (for example, SUS material) having an upper end surface which is formed flat, so that, when the adsorbing pad 35 adsorbs the wafer, the wafer cannot be deformed by the adsorbing force of the pad. Further, there is interposed a bellow-phragm 36 between the adsorbing pad 35 and the cylinder 31. Numerals 39, 40, 41 respectively designate O-rings, and 42A stands for a packing.

Next, description will be given of the operation of the vacuum chuck 30 constructed in the above-mentioned manner.

At first, prior to the beginning of the slicing of the ingot 10, the collect plate 24 is moved so that 6 vacuum chucks 30 are opposed to the end face of the slicing side of the ingot 10. And, after the movement of the collect plate 24 is caused to stop, a vacuum pump (not shown) is turned on to thereby generate a negative pressure in the tip end of the adsorbing pad by means of the arm 26, the vacuum hole 34C in the collect plate 24, vacuum tube 34B, vacuum hole 34A in the piston 34, vacuum rod 33 and support ball 32, and at the same time compressed air is supplied through a supply hole 42 (which is shown in FIG. 15) to the lower portion of the piston 34 to move the piston 34 upwardly. Now, FIGS. 20 and 21 respectively illustrate the states in which the piston 34 is moved up to the upper-most end.

During the upward movement of the piston 34, the six adsorbing pads 35 are elevated and inclined respectively according to the shape of the ingot end face to adsorb the ingot end face in such a manner that they are in close contact with the ingot end face with no clearance therebetween. In this condition, the whole collect plate 24 and the arm 26 supporting the collect plate 24 are being flexed due to a reaction force from the ingot end face against the pressure of the piston 34.

In this state, the compressed air supplied to the lower end portion of the piston 34 is released atmospherically (that is, it is released down to the atmospheric pressure level). This dissolves the flection of the collect plate 24 and the like, so that they are not distorted at all. That is, in this state, the adsorbing pad 34 is attaching to the ingot end face only by means of its adsorbing force and, therefore, any pushing or pulling force acts on the ingot end face no longer.

After then, the side portion of the cylinder 31 is pressed by use of the clamp pin 56 to thereby fix the piston 34.

As mentioned above, since the end face of the slicing side of the ingot 10 is fixed, a wafer that is sliced out is prevented from swaying during the slicing and also, due to the fact that no pushing force or the like from the collect plate 24 side acts on the wafer, the wafer can never be broken at all until the slicing is completed. Here, since the adsorbing pad 35 is constructed in an oscillatable manner, there may arise a fear that the wafer may be swayed during the slicing. But, this fear is avoided. Specifically, since the respective adsorbing pads 35 are fixed such that they are unable to advance or retreat and a large number of adsorbing pads 35 are located dispersed evenly over the ingot end face to be adsorbed, the ingot end face can be fixed wholly, eliminating the possibility that the wafer may be swayed. Also, since the porous pads 35A are provided on the upper ends of the adsorbing pads 35, respectively, and also the adsorbing surfaces thereof are formed flat, the stresses or the like due to the adsorbing forces thereof will never act on the wafer.

Next, description will be given of a clamp device for fixing the above-mentioned respective piston 34.

Figure 22:
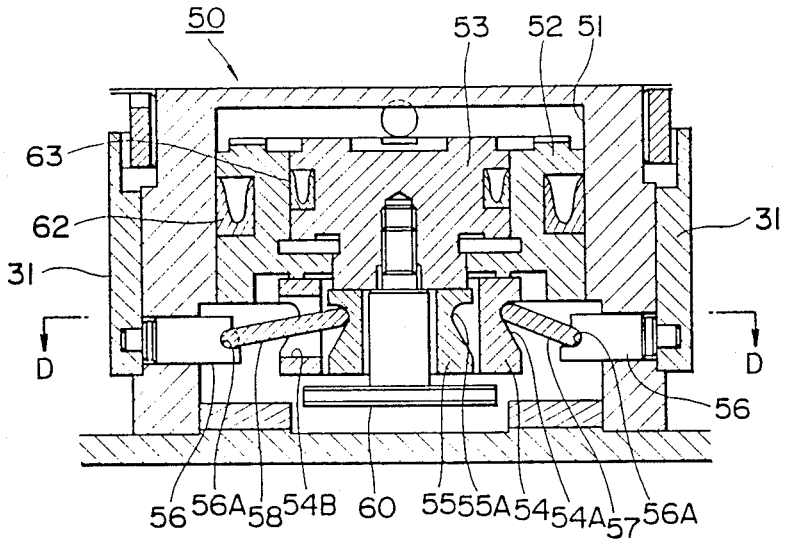
FIG. 22 is an enlarged view of a clamp device shown in FIG. 16.
Figure 23:
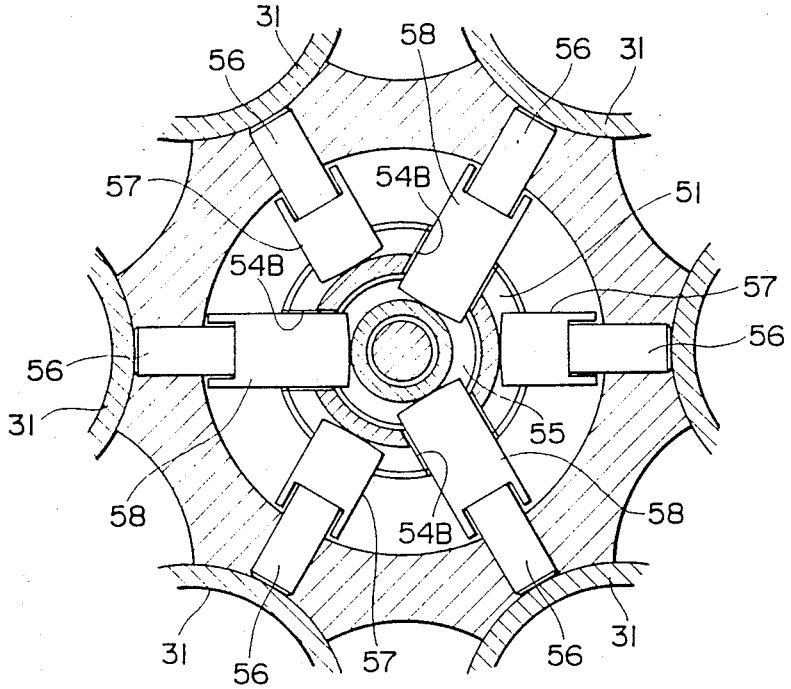
FIG. 23 is a section view taken along the line D-D in FIG. 22.

FIG. 22 is an enlarged view of the clamp device 50 which is enclosed by a one-dot chained line in FIG. 16, and FIG. 23 is a section view taken along the line D-D in FIG. 22. The clamp device 50 mainly comprises a cylinder section 51 formed in the central portion of the collect plate 24, a first piston 52 which is formed hollow and is slidable within the cylinder section 51, a second piston 53 slidable within the first piston 52, first and second rings 54, 55 which are respectively pressed by the first and second pistons 52, 53, 6 clamp pins 56 which are provided so as to extend slidably through the peripheries of the cylinder section 51 and are located radially at equal intervals, a first plate 57 interposed between the first ring 54 and three of the clamp pins 56, and a second plate 58 interposed between the second ring 55 and the other three clamp pins 56.

There is provided a stopper 60 on the lower end of the second piston 53, the second ring 55 is interposed between the second piston 53 and the stopper 60, and the first ring 54 is interposed between the first pin 52 and the stopper 60.

The above-mentioned first and second rings 54, 55 are respectively formed in the peripheries thereof with grooves 54A, 55A which are respectively used to secure or engage the ends of the first and second plates 57, 58. Similarly, each of the clamp pins 56 is formed in the rear end thereof with a groove 56A for securing the other ends of the first and second plates 57, 58. Also, the respective leading ends of the 6 clamp pins 56, as described before, are fitted into the outer peripheral portions of the respective cylinders 31 of the 6 vacuum chucks 30 (see FIGS. 23 and 18).

In addition, the first ring 54 is formed with a hole 54B through which the second plate 58 can extend. Between the cylinder section 51 and the first piston 52, and between the first piston 52 and the second piston 53, there are interposed packings 62 and 63, respectively.

Next, description will be given of the operation of the clamp device 50 constructed in the above-mentioned manner.

As discussed before, when the collect plate 24 is moved to a position where it is opposed to the end face of the slicing side of the ingot 10, then the compressed air is fed from the air supply hole 42 (FIG. 15) to the lower portions of the respective pistons 34 of the 6 vacuum chucks 30, and at the same time the compressed air is supplied to the respective lower portions of the first and second pistons 52 and 53 of the clamp device 50 as well.

As a result of this, the first and second pistons 52 and 53 are moved upward, and at the same time, due to the upward movement of the stopper 60 that is connected to the second piston 53, the first and second rings 54 and 55 are also moved upward. Thanks to the upward movements of these rings 54, 55, the ring securing sides of the first and second plates 57 and 58 are lifted up, respectively, with the result that the pushing faces by the clamp pins 56 on the cylinders 31 are removed and thus the pistons 34 of the vacuum chucks 30 are allowed to slide within the cylinders 31, respectively.

After then, as mentioned before, after the ingot end face is adsorbed by the 6 vacuum chucks 30, the respective pistons 34 of the 6 vacuum chucks 30 are fixed simultaneously.

In other words, in order to fix the respective pistons 34 of the vacuum chucks 30, the compressed air is supplied through the air supply hole 43 and air supply passage 43A (see FIGS. 15 and 17) to the respective upper portions of the first and second pistons 52 and 53 of the clamp device 50. On the other hand, the respective lower portions of the first and second pistons 52 and 53 are open to the atmospheric air.

Consequently, the first and second pistons 52 and 53 are pushed downward independently of each other to press down the first and second rings 54 and 55, respectively. And, the first and second rings 54 and 55 press against the radially arranged six clamp pins 56 respectively through the first and second plates 57 and 58, and these six clamp pins 56 in turn press against the side portions of the respective cylinders 31 of the 6 vacuum chucks 30 to thereby clamp the respective pistons 34 in the cylinders 31.

When the above-mentioned clamping is completed, the degrees of inclination of the first and second plates 57 and 58 approach to the horizontal direction and the amounts of movements of the clamp pin securing sides of the plates 57, 58 become extremely smaller over the amounts of movements of the ring securing sides of the plates 57, 58, with the result that great pressures are applied to the clamp pins 56. Also, the first piston 52, first ring 54 and first plate 57, and the second piston 53, second ring 55 and second plate 58 are adapted to operate independently of each other, that is, the first and second groups independently clamp the pistons 34 of the vacuum chucks 30, respectively through three of the six clamp pins 56. Thanks to this dual structure, the clamping can be achieved for certain.

The above-mentioned clamp device 50 can also be applied as means to simultaneously fix the plurality of keep pins 112 shown in FIG. 7.

Figure 24:
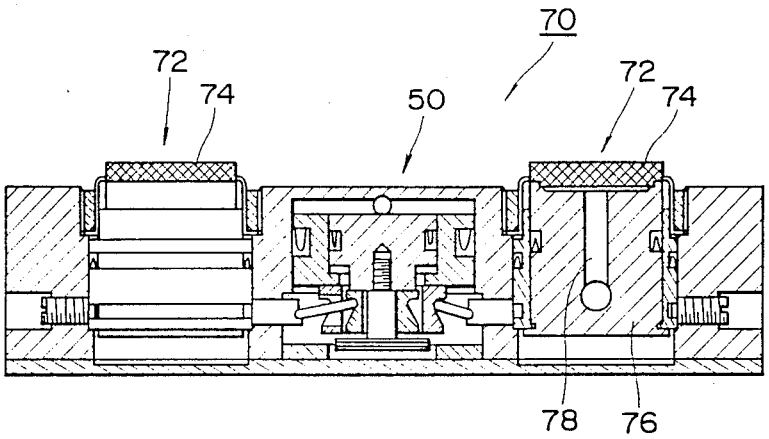
FIGS. 24 and 25 are section views of another embodiment of the collect plates employed in the fifth embodiment according to the invention.

Referring now to FIG. 24, there is shown a section view of another embodiment of the collect plate which is applied to the fifth embodiment according to invention, illustrating the same section with that of the collect plate 24 discussed before (FIG. 16). As shown in FIG. 24, the collect plate 70 has substantially the same structure as the above-mentioned collect plate 24, but the collect plate 70 is different from the collect plate 24 in that the adsorbing pad 74 of a vacuum chuck 72 is not supported by means of the spherical surface bearing structure but it is fixed directly on a piston 76. In this figure, 78 designates a ventilation passage for vacuum.

The thus constructed collect plate 70 is effective when the degree of the flatness of the slicing end face of an ingot is very high (for example, the end face is ground). The use of the collect plate 70 eliminates the need of the spherical surface bearing structure in the adsorbing pad, so that a simplified unit sturcture can be realized.

Also, in the above-mentioned cutting method using the fifth embodiment shown in FIG. 1, if the arm 26 is lowered down a very slight amount prior to the starting of cutting by the blade 12 after the collect plate 24 has been adsorbed to the end face of the ingot 10, then a better cutting can be obtained.

In other words, if the arm 26 is moved down a very slight amount, due to the fact that the collect plate 24 is being adsorbed to the end face of the ingot 10, the arm 26 is then flexed correspondingly to the amount of the downward movement thereof, so that a tensile force due to the flexion of the arm 26 can be applied to the end face of the ingot 10. For this reason, in the cutting process, the wafer is always pulled in a direction away from the blade 12, which can improve the cutting performance. It should be noted here that the amount of the downward movement of the arm 26 must be set at such a slight amount that cannot give rise to any breakage in the end chip of the wafer.

Figure 25:
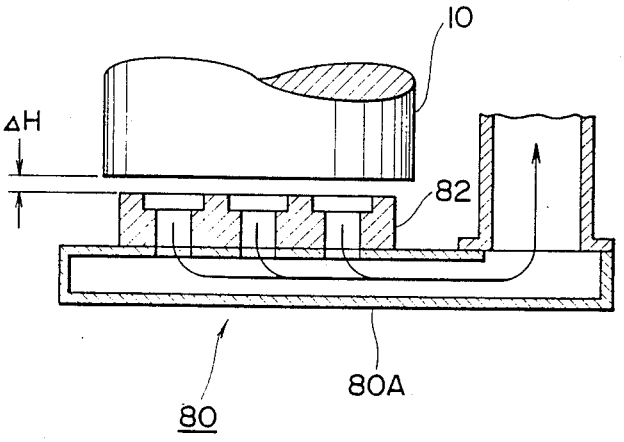

Further, in the above-mentioned cutting method, a simple collect plate 80 shown in FIG. 25 besides the collect plates 24 and 70 respectively shown in FIGS. 13 through 23 and FIG. 24, can also be employed. That is, a pad 82 which is provided on the collect plate 80 is fixed to a main body 80A of the collect plate 80 in a simple manner and is also formed with holes for vacuum. The pad 82 is made of carbon or a similar material so that the flatness of the pad 82 as well as the parallel condition thereof relative to the ingot end face can be assured when the cutting is done by the blade 12.

And, as shown in FIG. 25, if the collect plate 80 is set such that there can be provided a slight clearance ΔH between the end face of the pad and the ingot end face and a vacuum is then turned on, the pad end face and the ingot end face are then adsorbed to each other. Therefore, if the cutting is started thereafter, then the wafer is always pulled downward during the cutting process, so that a similar effect to the one above-mentioned can be obtained, that is, an improved cutting performance is possible.

As has been described heretofore, according to the invention, the slicing stresses that are produced with the progress of the ingot slicing by the blade can be transmitted and dispersed to the immovable base end side of the ingot and the holder device and the like on the slicing side of the ingot and, therefore, there is eliminated the possibility that in the final slicing area the ingot may be broken in the unsliced portion before completion of the slicing, that is, the yield rate of the ingot can be improved. Also, as can be understood from the foregoing description, according to the invention, since the occurrence of the ingot breakage can be prevented, there is eliminated the need of the slice base which has been used only for prevention of the ingot breakage. This saves the material costs of the slice base and, in addition, the steps of attaching the slice base, removing it after it is sliced, and disposing it can be eliminated, which results in the improved operationability and productivity, that is, the economic efficiency and quality of the wafers can be remarkably enhanced. Further, due to the fact that the holder device according to the invention employs the keep pins, even the pin contact surface of the ingot slicing side is formed uneven or inclined, the ingot slicing side surface can be contacted evenly by the keep pins. That is, the present holder device can apply to the ingot slicing or cutting end side of any shape, provided that the vacuum holder device main body is adsorbable thereto. Moreover, according to the invention, in structure, the vacuum holder device according to the invention may be attached to one of conventional structures to attain its object with only slight increase of costs. In other words, according to the invention, a practically useful device can be supplied.

In addition, according to the invention, when the end face of the slicing side of the ingot is adsorbed and held, the adsorbing pads can be brought into contact with the end face with no clearance therebetween and in such a manner that unnecessary external forces will never act onto the end face from the adsorbing pads side. This eliminates the possibility that the sliced piece, whether it is a very thin wafer or it is formed of a fragile material such as GaAs or the like, may be damaged or broken.

It should be understood, however, that there is no intention to limit the invention to the specific forms disclosed, but on the contrary the invention is to cover all modifications, alternate constructions and equivalents falling within the spirit and scope of the invention as expressed in the appended claims.

What is claimed is:

1. A method of cutting a cylindrical material, comprising the steps of: fixing a base end side of said cylindrical material; locating a plurality of forwardly and backwardly movable keep pins such that said keep pins are opposed to an end face of a cutting side of said cylindrical material; pressing said plurality of keep pins against said end face of said cylindrical material before the cutting of said cylindrical material is started; thereafter fixing said keep pins immovable; attracting said end face of said cylindrical material cutting side toward said keep pins to thereby fix said end face; and, cutting said cylindrical material by a rotating blade while fixation of said end face is maintained until the cutting of said cylindrical material is completed.

2. A method of cutting a cylindrical material, comprising the steps of: fixing a base end side of said cylindrical material; arranging a plurality of cylinders opposed to an end face of a cutting side of said cylindrical material, said cylinders having adsorbing pads on pistons of each cylinder for attracting said cylindrical material through means of spherical surface bearings; operating said plurality of cylinders to press said adsorbing pads against said end face of said cylindrical material, before the cutting of said cylindrical material is started; thereafter, after the pressing forces applied to said adsorbing pads by said cylinders are removed, with said adsorbing pads being adsorbed to said cylindrical material end face, fixing said pistons of said cylinders such that they cannot be moved forwardly and backwardly; and, cutting said cylindrical material by a rotating blade.

3. An apparatus for cutting a cylindrical material in which a blade is rotated to cut the cylindrical material with a base end side thereof being fixed, characterized in that an end face of a cutting side of said cylindrical material is adsorbed and held by adsorbing and holding means before the starting of said cutting, and said cutting of said cylindrical material is performed while maintaining said adsorbing and holding state until said cutting is completed;

wherein said adsorbing and holding means comprises:

a plurality of slide members disposed opposed to said cutting side end face of said cylindrical material with the base end side thereof being fixed;

attraction means for generating adsorbing forces so that said cutting side end face of said cylindrical material can be brought into contact with and held by leading ends of said plurality of slide members;

a cylinder section interposed substantially centrally among said plurality of slide members and at least one piston slidable within said cylinder section;

a plurality of clamp pins disposed so as to extend radially from said cylinder section toward said plurality of slide members;

means responsive to the operation of said piston to transmit pressing forces to said plurality of clamp pins in such a direction in which said plurality of clamp pins press and fix said plurality of slide members;

wherein said plurality of slide members are respectively fixed with said leading ends thereof being in contact with said cutting side end face of said cylindrical material in accordance with the shape of said end face.

4. An apparatus for cutting a cylindrical material as set forth in claim 3, wherein said slide member is a cylinder including a piston provided with an adsorbing pad by means of a spherical surface bearing.

5. An apparatus for cutting a cylindrical material as set forth in claim 3, wherein a securing portion is formed in one of said piston and or means to be pressed by said piston, and a connecting member is interposed between said securing portion and a securing portion formed in said clamp pin and inclinable from an inclined position thereof to a substantially horizontal position responsive to the operation of said piston.

6. An apparatus for cutting a cylindrical material in which a blade is rotated to cut said cylindrical material with a base end side thereof being fixed, said apparatus comprising:

a plurality of cylinders arranged opposed to an end face of a cutting side of said cylindrical material with the base end side thereof fixed;

pistons slidably disposed in said cylinders;

adsorbing pads disposed on said pistons by means of spherical surface bearings, said adsorbing pads being provided in a top end portion thereof with a porous pad having an upper end surface which is formed flat;

attraction means for allowing said adsorbing pads to generate adsorbing forces; and means for fixing said respective pistons such that they are unable to advance and retreat, characterized in that, with said adsorbing part being adsorbed to the end face of said cylindrical material, said pistons of said cylinders are fixed respectively.

7. An apparatus for cutting a cylindrical material in which a blade is rotated to cut said cylindrical material with a base end side thereof being fixed, said apparatus comprising:

a plurality of cylinders arranged opposed to an end face of a cutting side of said cylindrical material with the base end side thereof fixed;

pistons slidably disposed in said cylinders;

adsorbing pads disposed on said pistons by means of spherical surface bearings;

attraction means for allowing said adsorbing pads to generate adsorbing forces; and, means for fixing said respective pistons such that they are unable to advance and retreat, characterized in that, with said adsorbing part being adsorbed to the end face of said cylindrical material, said pistons of said cylinders are fixed respectively.

8. An apparatus for cutting a cylindrical material as set forth in claim 7, wherein said plurality of cylinders are air cylinders which are arranged in a movable collect plate.

9. An apparatus for cutting a cylindrical material as set forth in claim 7, wherein each of said pistons is provided with a vacuum rod including an adsorbing pad support ball in one end thereof, and each of said adsorbing pads is supported by said pad support ball such that said adsorbing pads are inclinable.

10. An apparatus for cutting a cylindrical material as set forth in claim 9, wherein said vacuum rod and pad support ball are formed with a vacuum hole in the central portions thereof.

11. An apparatus for cutting a cylindrical material as set forth in claim 10, wherein each of said piston provided with said vacuum rod is formed with a vacuum hole extending transversely through said piston and communicating with said vacuum rod hole, and the resective vacuum holes in said plurality of pistons are allowed to communicate with one another by means of a vacuum tube.

12. An apparatus for cutting a cylindrical material as set forth in claim 7, wherein a bellow-phragm is interposed between said adsorbing pad and cylinder.

13. An apparatus for cutting a cylindrical material as set forth in claim 12, wherein said piston is formed with a through ventilation bore for maintaining in the same level the respective pressures of the upper and lower portions of said piston.

* * * * *

UNITED STATES PATENT AND TRADEMARK OFFICE

CERTIFICATE OF CORRECTION

PATENT NO. : 4,903,681

DATED : February 27, 1990

INVENTOR(S) : Katsuo HONDA et al.

It is certified that error appears in the above-identified patent and that said Letters Patent is hereby corrected as shown below:

ON THE FIRST PAGE OF PATENT

"Assignee: Tokyo Seimitus Co., Ltd." should read
--Assignee: Tokyo Seimitsu Co., Ltd.--.

Signed and Sealed this

Sixteenth Day of April, 1991

*Attest:*

*Attesting Officer*

HARRY F. MANBECK, JR.

*Commissioner of Patents and Trademarks*